United States Patent [19]

Pardes

[11] 4,349,337

[45] Sep. 14, 1982

[54] MARKSMANSHIP TRAINING SYSTEM

[76] Inventor: Herman I. Pardes, 45 Wickapecko Dr., Ocean, N.J. 07712

[21] Appl. No.: 283,776

[22] Filed: Jul. 16, 1981

[51] Int. Cl.[3] ..... F41G 3/26

[52] U.S. Cl. ..... 434/20; 273/310; 434/22

[58] Field of Search ..... 434/20, 21, 22; 273/310, 311, 312

[56] References Cited

U.S. PATENT DOCUMENTS 3,352,556 11/1967 Chaskin ..... 273/310

3,888,022 6/1975 Pardes et al. ..... 434/20

4,137,651 2/1979 Pardes et al. ..... 434/20

4,170,077 10/1979 Pardes ..... 434/22

*Primary Examiner*—William H. Grieb

*Attorney, Agent, or Firm*—Nathan Edelberg; Jeremiah G. Murray; Michael C. Sachs

[57] ABSTRACT

A system for providing a simulated target and scene on a projector screen, wherein a first infrared (IR) detector senses reflected IR light from the screen to indicate an associated simulated weapon has hit the target and a second IR detector mounted in proximity to said first detector enables automatic sensitivity adjustment to different brightness backgrounds.

5 Claims, 6 Drawing Figures

MARKSMANSHIP TRAINING SYSTEM

The invention described herein may be manufactured and used by or for the Government for Governmental purposes without the payment to the inventor of any royalties thereon.

BACKGROUND OF THE INVENTION

A system is disclosed in U.S. Pat. No. 3,888,022, entitled MOVING TARGET SCREEN, issued to H. I. Pardes, et al., wherein motion picture scenes are projected on a viewing screen to provide trainees with simulated realistic scenes for tactical and marksmanship training.

The system disclosed in U.S. Pat. No. 3,888,022 is particularly directed such as to military applications in an environment wherein the system permits each of the weapons utilized to generate a low power laser beam which is aimed onto the target, and wherein there is a requirement to keep each weapon unencumbered such as by wire connections and accessories.

A system generally related to the foregoing is disclosed in U.S. Pat. No. 4,170,077, issued to H. I. Pardes, which system provides a simulated target scene on a projector screen, enabling the operator to practice marksmanship. This latter system is particularly applicable to permanent-type simplified installations, such as in fixed target ranges, or in amusement park games, where it is possible to hard-wire, that is, to electrically connect, the weapon to a scoring display.

In the system of U.S. Pat. No. 4,170,077, a film projector projects a target scene on the screen, with one or more targets located in each scene. When the weapon operator accurately fires his weapon at the target, the electronic circuitry indicates that the target has been hit. The invention provides a structure and technique for transmitting a modulated infrared light through an aperture in the film onto a viewing screen. The aperture is optically superimposed on a target on the screen; and the modulated infrared light reflected from the screen is detected by detectors mounted on a weapon when that weapon is accurately aimed at the target.

The system of U.S. Pat. No. 4,170,077 requires that a modulating grid and driver mechanism be inserted behind the film gate of the projector; and, while the system operates satisfactorily, it has been found that the insertion of the grid and driver mechanism is a complicated procedure, requiring the services of skilled technicians.

SUMMARY OF THE INVENTION

The present invention discloses a system for providing a simulated target and scene on a projector screen, enabling an operator or user to practice marksmanship. A film projector projects a target scene on the screen, with one or more targets located in each scene. When the weapon operator accurately fires his weapon at the target, the electronic circuitry indicates that the target has been hit. An optical structure and technique is provided for transmitting an invisible infrared light through a clear aperture on the film and superimposing this light on a target viewed on a projection screen. The infrared (IR) light reflected from the screen is detected by balanced IR detectors, mounted on a weapon, when that weapon is accurately aimed at the target.

In the present invention, there is no modification required to a conventional projector, other than the external lens attachment; and it is therefore applicable to virtually any motion picture or slide projector.

Further objects of the invention will be readily apparent from the following detailed description of preferred embodiments, when considered in conjunction with the drawings, wherein:

DESCRIPTION OF THE PREFERRED EMBODIMENT OF THE INVENTION

Figure 1:
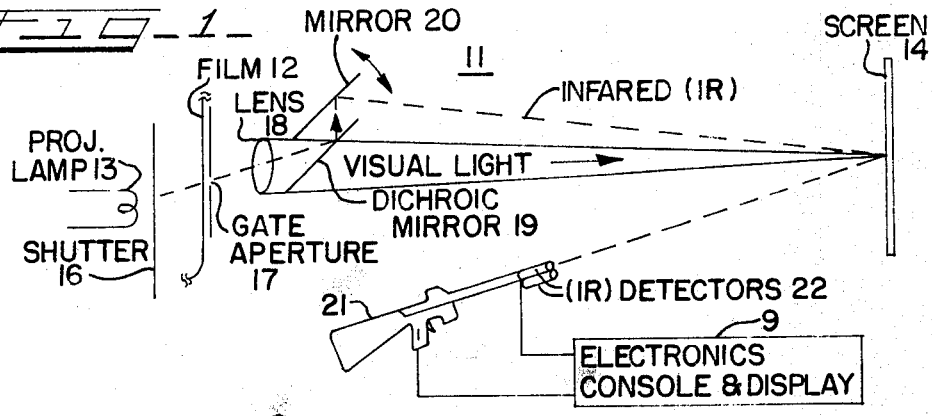
FIG. 1 depicts the optics or lens assembly utilized in the projection system of the invention.

FIG. 1 depicts the optics or lens assembly 11 of the invention. Reference is also made to U.S. Pat. No. 3,888,022 to Pardes, et al., and to U.S. Pat. No. 4,170,077, cited hereinabove, which describe the basic details of the optics assembly such as shown in FIG. 1. Both of said patents are specifically incorporated herein by reference. As indicated in the drawing, the pictorial scene or image on a film 12 frame is projected onto the viewing screen 14 by a projection lamp 13, shutter 16, gate aperture 17, condensing lens 18, and a stereo reflector consisting of a dichroic mirror 19 and a first surface mirror 20.

Figure 5:
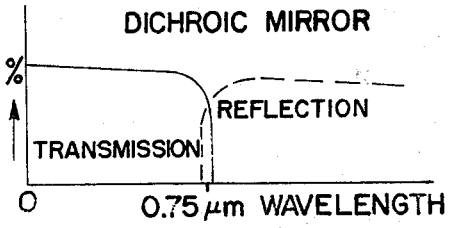
FIG. 5 is a graph, useful in explaining the operation of the invention.

As is known, dichroic mirror 19 is designed to pass light having wavelengths within a certain range and to reflect light having wavelengths outside of the selected range. For example, in FIG. 5, the dichroic mirror 19 is designed to pass light of a wavelength below approximately 0.75 micrometers and to reflect light above that wavelength. Dichroic mirror 19 is positioned at approximately a 45° angle with the plane of the lens 18, as shown in FIG. 1; and the visible light from the projection lamp 13 passes through the lens 18 and the dichroic mirror 19 to illuminate the screen 14. The infrared (IR) light from projection lamp 13, which is above 0.75 mm in wavelength, will be reflected upwardly by the mirror 19 toward mirror 20. Mirror 20 is tiltable and adjustable relative to the stationary dichroic mirror 19, and is adjusted to reflect the infrared (IR) light beam toward the screen 14, as shown in FIG. 1.

Mirror 20 may also be a dichroic mirror so that any residual visible light, which may be undesirable, is virtually eliminated. Most of such residual visible light would pass through mirror 20 and, hence, would not be reflected toward the screen; a 90%–100% transmission ratio is standard.

The film 12 projection provides a pictorial scene on screen 14; and each scene has one or more targets located thereon. In operation, the marksman aims his weapon (rifle) 21 at the target. Weapon 21 has infrared (IR) detectors, generally labeled 22, mounted thereon, as will be described hereinbelow. When weapon 21 is properly aimed at the target 24, and its trigger is actuated to enable the associated electronic circuit, infrared (IR) light reflected from the screen 14 actuates the IR detector 22A to provide an indication that the weapon has effectively hit the target, all of which will be explained hereinbelow.

Figure 3:
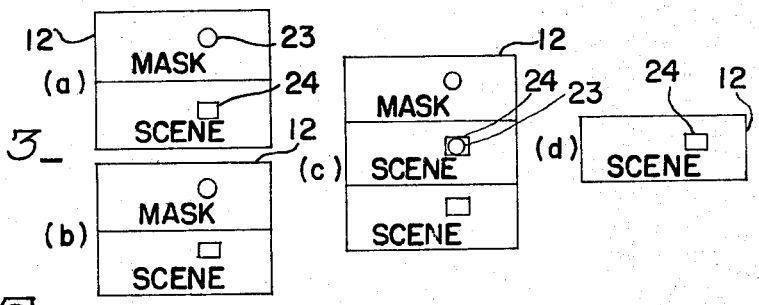
FIG. 3 shows a film superpositioning arrangement utilized in the invention.

Refer now also to FIG. 3, which illustrates the superpositioning of film frames, as discussed in detail in U.S. Pat. No. 3,888,022, cited above. In FIG. 3, one-half of each film frame 12 contains an inverted normal positive scene, while the other half of each film frame contains a mask consisting of an opaque background in which there are formed one or more transparent apertures 23. The aperture or apertures 23 are located at the same relative position on the mask portion of each film frame 12 as the corresponding target or targets 24 on the scene portion of each frame. Thus, as labeled in FIG. 3, each projected film frame 12 includes a scene portion and a mask portion, within which respective bright spots (corresponding to the aperture 23) appear. Apertures 23 are approximately 0.5 mm across.

Figure 4:
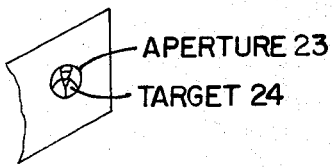
FIG. 4 shows an aperture superpositioned on a target.

In the operation of the system of FIG. 1, a film frame 12, with a scene and a mask image (see FIG. 3*a*), is projected through the dichroic mirror 19 onto the screen 14. A second and identical scene and mask image (see FIG. 3*b*) is reflected from dichroic mirror 19 to mirror 20, and thence projected onto the screen 14. The movable mirror 20 is next adjusted until the apertures 23, or bright spots in the mask portion, are superimposed on the targets 24 in the scene portion of the projected image, as indicated in FIG. 3*c*. Accordingly, only the scene portion of the projected image will be visible to the marksman; but the scoring aperture 23 will effectively be positioned on the target 24, as indicated in FIG. 4.

The operator or trainee thus sees the actual target scene on the screen, and aims the weapon 21 at the target 24. When the weapon 21 is accurately aimed at the target, the infrared light reflected from the screen 14 impinges on detector 22A in the weapon 21, as indicated by the dotted lines in FIG. 1. The inventive system thus simulates an actual firing condition by means of film.

Figure 2:
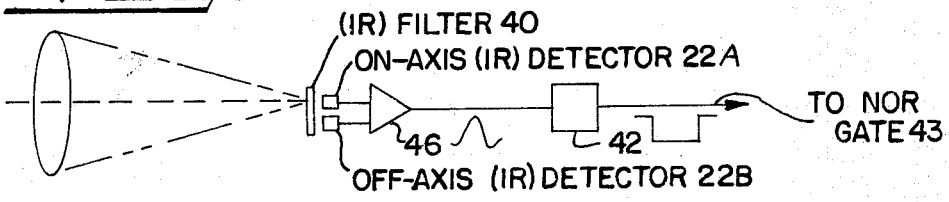
FIG. 2 is a view of the balanced IR detector assembly, mounted on or in the weapon barrel.

As shown in FIG. 1, and in somewhat enlarged size in FIG. 2, the dual IR detectors, generally labeled as 22 and individually labeled as 22A and 22B, are mounted at the focal plane of optical system; their output feeds into a differential amplifier 41. One of the detectors, that is, detector 22A, is "on-axis", that is, boresighted with the weapon 21. The other detector, 22B, mounted in very close proximity to detector 22A but "off-axis", is provided to balance out background illumination. By this technique, the optical triggering level is automatically adjusted such that a target 24 can effectively move from a bright background to a dark background without a manual sensitivity adjustment of the detector 22 circuitry. Also, as indicated in FIGS. 2 and 6, an IR filter 40 is provided for each weapon to assure that only the infrared light is effective on or sensed by the detectors 22.

Figure 6:
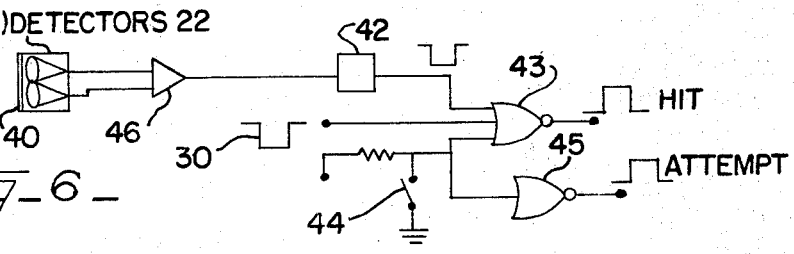
FIG. 6 shows a logic diagram of a portion of the electronic circuit of the inventive system.

An electronic diagram of the weapon activation and hit indication portion of the electronics control and display circuit is shown in FIG. 6. When the weapon is properly aimed and fired at the target 24, the infrared light is filtered through the narrow band filter 40 and impinges on the "on-axis" detector 22A. As mentioned, the "off-axis" detector 22B senses the illumination of the area adjacent the target and provides a variable reference to effectively balance out background illumination. The detectors 22 provide a signal through a differential amplifier 46 to trigger a one-shot multivibrator 42 to provide a negative pulse to a three-input NOR gate 43.

When the weapon is actuated to simulate firing, trigger switch 44 is momentarily (for approximately 42 m. sec.) closed to effectively enable NOR gates 43 and 45. A third input pulse 30 is coupled to NOR gate 43 from, for example, a 1 to 10 decoder in the electronics console and display 9 to individually monitor each one of up to ten weapons in use. As is known, NOR gate 43 will be enabled when its three inputs occur concurrently to provide a hit indication on the display 9 of FIG. 1. An indication on the weapon 21, such as an LED display, may also be activated by NOR gate 43 to indicate a hit.

As can readily be appreciated, each time the trigger switch 44 closes, it activates NOR gate 45 to provide an output pulse, indicating the firing of the weapon in an attempt to hit the target. Accordingly, the attempts versus hits is readily ascertainable.

Multi-station operation may be implemented, as disclosed in U.S. Pat. No. 3,888,022, by electronic time sharing.

While the invention has been particularly shown and described with reference to a preferred embodiment thereof, it will be understood by those skilled in the art that various changes in form and details may be made therein without departing from the spirit and scope of the invention.

I claim:

1. A system for enabling marksmanship practice, comprising, in combination, a film frame projector providing visible and infrared light, a viewing screen, at least one apparatus simulating a weapon such as a rifle, a first infrared detector mounted on said weapon to receive infrared light beamed along the axis of said weapon, optical means for directing the images of a film to provide a composite visible scene and infrared target area on said screen at which said weapon may be aimed, and said screen reflecting said visible and infrared light whereby said first infrared detector on said weapon responds to said infrared light when said weapon is accurately aimed and simultaneously fired at said target, and a second infrared detector mounted off said axis and sensing infrared light from the scene adjacent said target whereby said second infrared detector provides an optical reference level for balancing background illumination.

2. An apparatus as in claim 1, further including differential signal processing circuitry, and said detectors being coupled thereto to provide a composite output signal.

3. An apparatus as in claim 2, wherein said second detector is mounted off of the weapon axis and in close proximity thereto, whereby a target may move from a bright background scene to a dark background scene and said second detector senses the infrared light from the scene adjacent the target and the output from said second detector enables automatic sensitivity adjustment for said first detector and said system.

4. A system as in claim 1, wherein each film scene includes a target scene portion and a mask portion, and a light aperture is formed in said mask portion corresponding in position to a target on said scene portion, said optical means including lens, a first mirror and a dichroic mirror, said dichroic mirror positioned in the path of the projected images and of the infrared light and positioned at an angle with respect to the plane of said lens for allowing visible light to pass therethrough onto said screen while reflecting the infrared light, said first mirror positioned to receive infrared light reflected by said dichroic mirror and arranged to reflect said infrared light to said screen to optically superimpose the aperture on said target and cause the infrared light to impinge on the target projected on said screen.

5. An apparatus as in claim 1, further including a narrow band infrared filter for filtering out any undesired light which might be sensed by said detectors.

* * * * *